US006087926A

United States Patent [19]

Hajianpour

[11] Patent Number: 6,087,926

[45] Date of Patent: Jul. 11, 2000

[54] FOOT PRESSURE MONITOR

[76] Inventor: Mohammed A. Hajianpour, 1706 Vestal Dr., Coral Springs, Fla. 33071

[21] Appl. No.: 09/330,776

[22] Filed: Jun. 11, 1999

Related U.S. Application Data

[60] Provisional application No. 60/089,022, Jun. 12, 1998.

[51] Int. Cl.[7] ..... G08B 21/00

[52] U.S. Cl. ..... 340/240; 340/279; 340/665; 340/573

[58] Field of Search ..... 73/172; 36/132; 340/272, 240, 573, 279

[56] References Cited

U.S. PATENT DOCUMENTS 3,974,491 8/1976 Sipe ..... 340/727
4,858,620 8/1989 Sugarman et al. ..... 128/774
5,357,696 10/1994 Gray et al. ..... 36/136
5,642,096 6/1997 Leyerer et al. ..... 340/573

*Primary Examiner*—Jeffery A. Hofsass
*Assistant Examiner*—Hung Nguyen
*Attorney, Agent, or Firm*—Ronald V. Davidge

[57] ABSTRACT

Apparatus is configured to provide an alarm perceivable by a user when an increase in a level of force applied to a foot exceeds a threshold value determined by a variable resistance. The level of force is determined from a pressure established within a transducer in an insole placed, for example, within the shoe of the user. This pressure is converted into an electrical signal within a pressure transducer within a control box. This electrical signal charges a capacitor to produce a voltage which is compared with a voltage level corresponding to the threshold value. The result of this comparison is used to determine when the alarm is provided.

9 Claims, 3 Drawing Sheets

FOOT PRESSURE MONITOR

This application claims benefit of a prior filed copending provisional application, Ser. No. 60/089,022, filed Jun. 12, 1998.

BACKGROUND OF THE INVENTION

1. Field of the Invention

This invention relates to an apparatus for providing an alarm when a change in the force applied to a foot exceeds a preset threshold value, and, more particularly, to such apparatus operated by a transducer placed in an insole placed, for example, in an insole of the user's shoe.

2. Background Information

In many instances, it is necessary for an individual to limit the pressure (actually, the force) exerted on one of his feet during walking. For example, such a limitation must be achieved after a broken bone is set or after various types of surgical procedures. There are many devices which are used to facilitate limiting the force placed on a foot during walking, such as crutches, walkers, and canes. However, the person using such a device generally has no effective feedback indicating whether he is allowing too much force be applied through his foot. In many cases, further damage can be done to an injured area, or the healing process can be delayed, by applying a force to the foot which is substantially lower than the force sufficient to cause pain.

Therefore, what is needed is a device measuring the force applied to a human foot and providing an alarm when this force exceeds a preset limit value.

SUMMARY OF THE INVENTION

In accordance with a first aspect of the present invention, apparatus provides an alarm when an increase in a level of force applied to a foot exceeds a threshold value. The apparatus includes an insole for placement inside a shoe, a second transducer, and an alarm. The insole includes a first transducer producing a first signal varying in response of a level of force applied to an upper surface of the insole. The second transducer generates a second signal in response to the first signal. The alarm generates a signal, perceivable to the user, in response to the second signal.

DETAILED DESCRIPTION OF THE INVENTION

Figure 1:
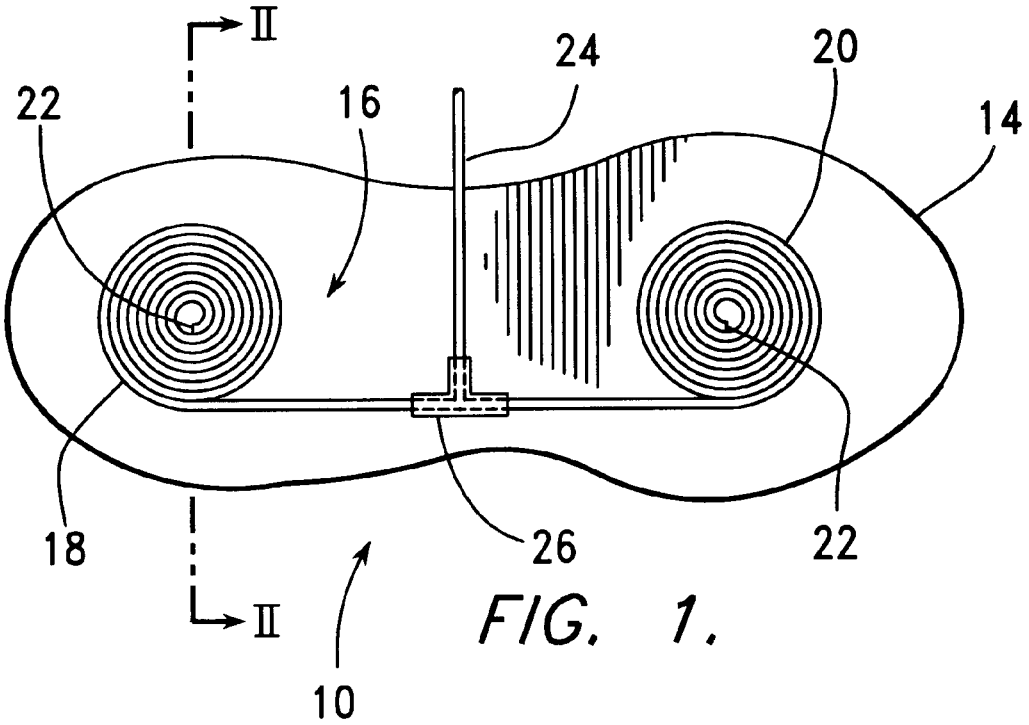
FIG. 1 is a plan view of a lower portion of a force-sensitive insole transducer, showing particularly an arrangement of flexible tubing used to convert force into air pressure.
Figure 2:
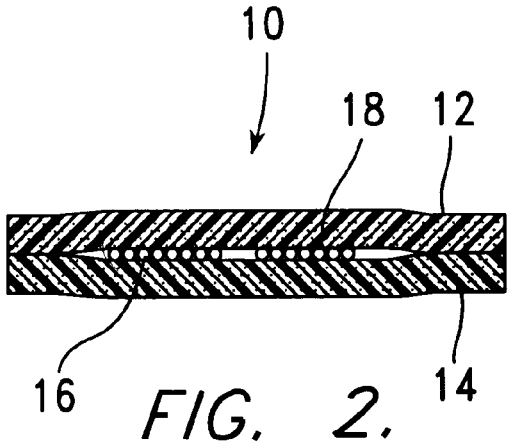
FIG. 2 is a transverse cross-sectional elevation of the insole transducer of FIG. 1, taken in the direction of section lines II—II in FIG. 1.

FIG. 1 is a plan view of a lower portion of a force-sensitive insole transducer, showing particularly an arrangement of flexible tubing used to convert force into air pressure, and FIG. 2 is a transverse cross-sectional elevation of the insole transducer of FIG. 1, taken in the direction of section lines II—II in FIG. 1;

Referring to FIGS. 1 and 2, a force-sensitive insole transducer 10 includes an upper layer 12 and a lower layer 14, between which a flexible tubing assembly 16 is placed, with these layers 12 and 14 preferably being adhesively attached to one another. The tubing assembly 16 includes a first pressure-sensitive coil transducer 18 formed with a spiral coil of flexible tubing placed where it is under the heel or rear portion of the foot of the individual, and a second pressure-sensitive coil transducer 20 formed with a spiral coil of flexible tubing placed where it is under the front portion of the foot of the individual. The inner end 22 of each of these coil transducers 18, 20, is sealed by the application of heat and pressure to the thermoplastic material of the tubing. The other ends of these coil transducers 18, 20 are both connected with an output tube 24 at a T-connection 26.

Figure 3:
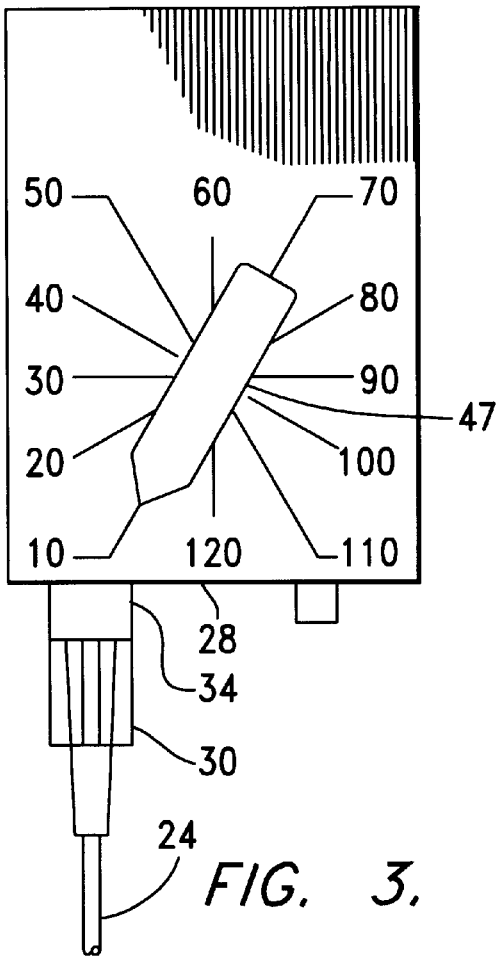
FIG. 3 is a front elevation of a control box used with the insole transducer of FIG. 1.
Figure 4:
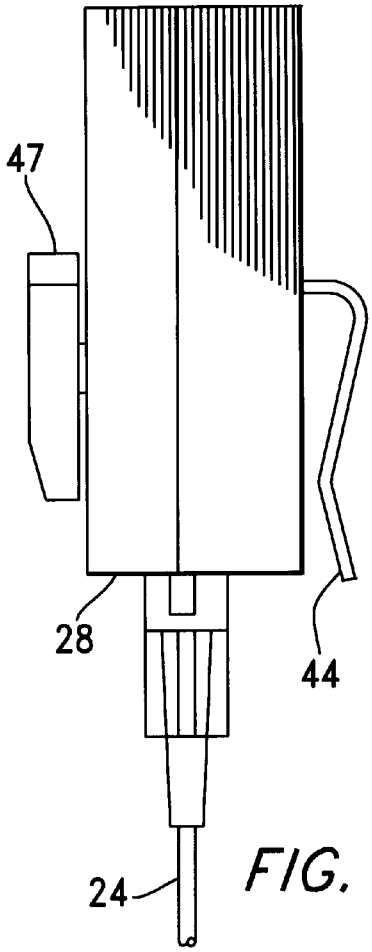
FIG. 4 is a right elevation of the control box of FIG. 3.
Figure 5:
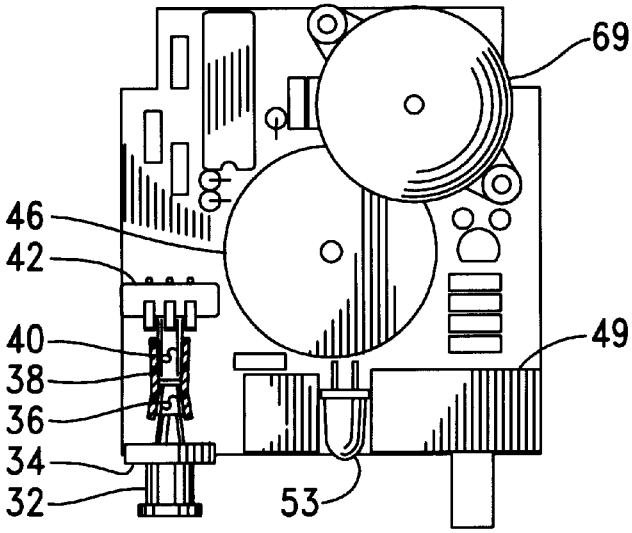
FIG. 5 is a front view of a circuit card within the control box of FIG. 3, together with various components assembled to this card.

FIGS. 3 and 4 are front and right elevations of a control box used with the insole transducer of FIG. 1, and FIG. 5 is a front elevation of a circuit card within the control box of FIGS. 3 and 4.

Referring to FIGS. 3 and 5, the output tube 24 from the insole transducer 10 extends upward to a control box 28, being terminated in a screw coupling 30 engaging the outer end 32 of an input coupling 34 extending from the control box 28. The inner end 36 of this coupling 34 is connected, by means of flexible tubing 38, to a tube 40 extending outward from a solid-state pressure transducer 42. This pressure transducer 42 is, for example, a Fujikura FPM-05PG Pressure Transducer, or, alternately, a Nova Sensor NPH-5-030G 0-5 PSI Pressure Transducer. The tube 40 has, at its end, a small hole (not shown) through which air is admitted into the pressure transducer 42 from the output tube 24. Inside the pressure transducer, air pressure is converted to an electrical output signal, and the air path entering through tube 40 is terminated as a cul de sac at its other end.

Referring to FIG. 4, the control box 28 additionally includes an external hook 44 facilitating carrying the control box 28 attached to a belt. The output tube 24 is long enough to extend, with the control box 28 carried in this manner, to the control box 28 from the insole transducer 10 within the shoe of an individual person. The output tube 24 is also flexible enough to allow its passage from the insole upward within the shoe, along the foot.

Referring to FIGS. 1, 3, and 5, in normal walking, the person using the device applies force alternately to the first pressure-sensitive coil transducer 18 and to the second pressure-sensitive coil transducer 20. With a shuffling movement sometimes associated with a foot or leg injury, force may be applied simultaneously to the coil transducers 18, 20. In either case, since the coil transducers 18, 20 are joined at T-connection 26, the air pressure established within output tube 24 is essentially proportional to the sum of the forces applied to the foot. When this total force exceeds a maximum level set using a rotary switch 46 operated by means of an external knob 47. During operation, an audible alarm is sounded within the control box 28 whenever a change in force exceeds the level set in the rotary switch 46.

Figure 6:
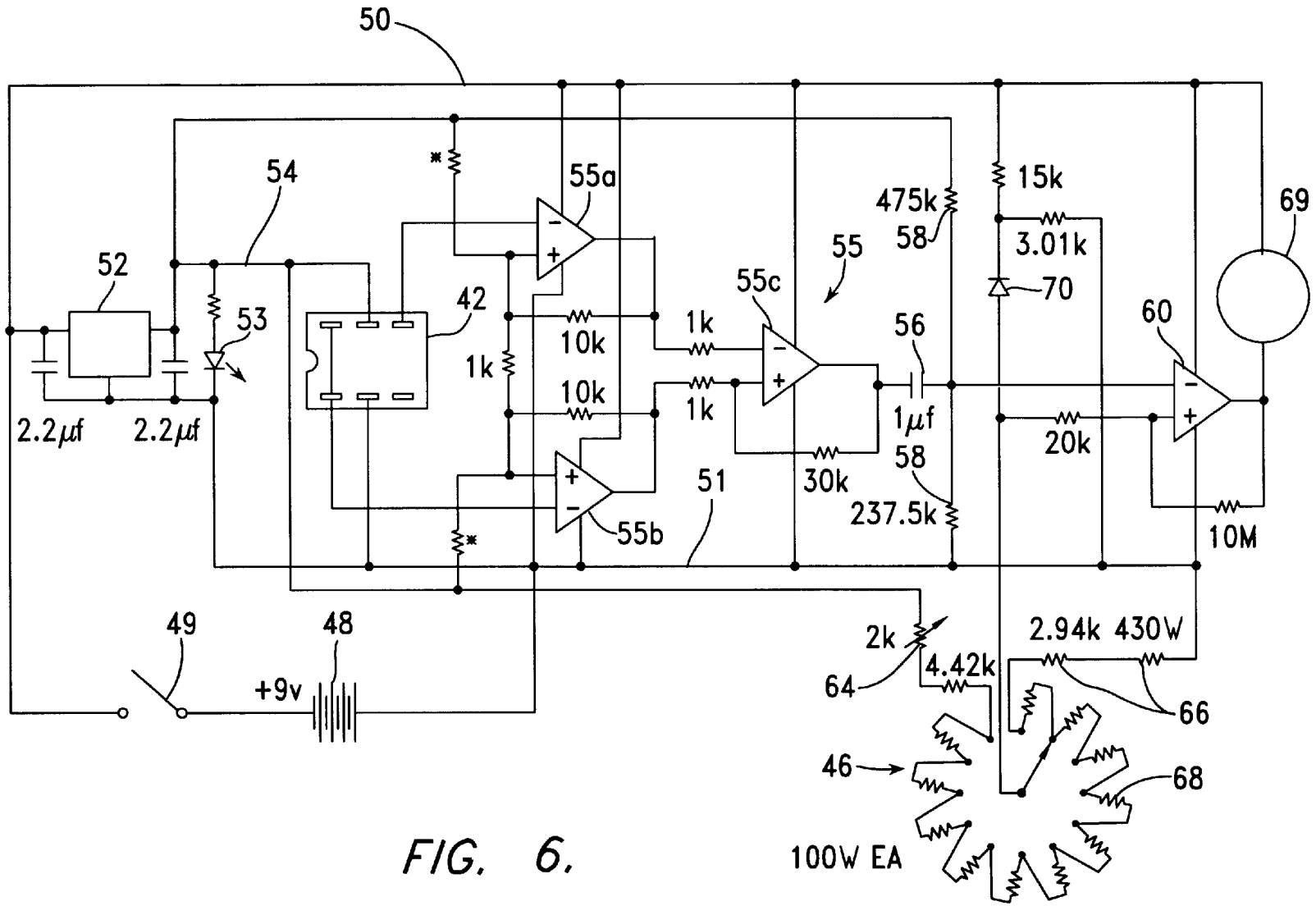
FIG. 6 is a schematic view of circuits within the control box of FIG. 3.

FIG. 6 is a schematic view of circuits within the control box 28. A nine-volt potential is applied to these circuits from a battery 48 within the control box 28, through a switch 49 to various points along the nine-volt power supply network indicated by 9 v supply network 50. The ground side of the battery is electrically connected to various points through an electrical ground network 51. Thus, the switch 59 is used to turn the device off and on.

A voltage regulator 52 provides 5 volts of regulated voltage as a power input to an LED 53 (also shown in FIG.

5), indicating that the device is "on," to the pressure transducer 42, and to other points through a voltage-regulated power network 54. The output signals from the pressure transducer 42 are provided as inputs to a bridge amplifier 55, which drives its output through a capacitor 56. The bridge amplifier 55 includes individual amplifiers 55*a*, 55*b*, and 55*c*. This capacitor 56, along with associated resistors 58, provides the circuit with a time constant, so that a comparator 60 is provided with an input to its negative input terminal reflecting changes in the force measured by the pressure transducer 42, while the long-term, or steady-state, level of this force is effectively ignored. This feature of the circuit is particularly important, since the long-term level of force measured by the pressure transducer 42 is effected by phenomena which are not to be measured by this device. For example, when someone places his foot into a shoe having the insole transducer 10, the pressure measured by the pressure transducer 42 gradually increases without the application of force, as the air within coil transducers 18, 20 is heated by body heat. Thus, without the capacitive coupling established through capacitor 56 between the bridge amplifier 55 and the comparator 60, the input from the amplifier 55 to the comparator 60 would drift, making calibration difficult or impossible. Also, since the circuit is configured to act upon changes in pressure, it is possible to break the connection between the input tube 24 at the screw coupling 30 and to re-establish this connection without having to be concerned with the quantity of air trapped within the flexible tubing assembly 16, the input tube 24, etc.

The resistors 58 also establish the steady-state voltage level to be applied to the negative input terminal of the comparator 60, forming a voltage divider between the 5-volt output of voltage regulator 52 and electrical ground. A voltage level determined by a second voltage divider 62 is applied to the positive input terminal of the comparator 60. This voltage divider 62 includes, on a side connected to the 5-volt output a variable resistor 64, which is used as a calibration adjustment, on the other side, which is connected to electrical ground, a pair of resistors 66. The rotary switch 46 operates in a step-wise manner to connect various resistors 68 to one side or the other of the voltage divider 62. In this way, the voltage applied to the positive input terminal of the comparitor 60 is incrementally varied.

The output of comparitor 60 is provided as an input to a beeper 69, which gives an audible alarm in response to a difference between the voltage output through capacitor 56 and the input to the positive input terminal of comparitor 60.

Under conditions of a low battery voltage, for example a voltage under eight volts, current flows through a diode 70, lowering the voltage applied to the positive input terminal of comparitor 60 so that a constant alarm is given through the beeper 69 to warn that the battery should be replaced.

The beeper 69 may be replaced with a device, such a permanent magnet motor driving an eccentric weight, producing predominantly vibrations instead of audible noise, for use in public areas without disturbing or alarming others. Thus, it is important that a signal, such as an audible signal or a vibration be produced in a form which is perceivable to the user.

While the invention has been described in its preferred form or embodiment with some degree of particularity, it is understood that this description has been given only by way of example, and that numerous changes in the details of construction, fabrication, and use may be made without departing from the spirit and scope of the invention.

I claim:

1. Apparatus for providing an alarm when an increase in a level of force applied to a foot exceeds a threshold value, wherein said apparatus comprises:

an insole, for placement inside a shoe, including a first transducer producing a first signal varying in response to a level of force applied to an upper surface of said insole;

a second transducer, generating a second signal in response to said first signal;

an alarm generating a perceivable signal in response to said second signal; and coupling means having a time constant, connecting said second signal to said alarm, so that said alarm responds to rapid changes in said second signal while ignoring gradual changes in said second signal.

2. The apparatus of claim 1, wherein said first transducer includes a first deflectable structure having a first chamber holding a quantity of air which is reduced by application of a force to a first portion of said upper surface of said insole, said second transducer includes a pressure transducer converting an input air pressure into an output voltage, said second signal is an electrical signal in response to said output voltage of said pressure transducer, and said apparatus additionally comprises a tube connecting said pressure transducer with said chamber within said first deflectable structure.

3. The apparatus of claim 2 wherein said first deflectable structure includes a flexible tube wound in a spiral configuration with a sealed end directed toward a center of said spiral configuration.

4. The apparatus of claim 2, wherein said first transducer additionally includes a second deflectable structure, having a second chamber holding a quantity of air which is reduced by application of a force to a second portion of said upper surface of said insole, and a tube connecting said first and second chambers, and said first and second deflectable structures extend along opposite ends of said insole.

5. The apparatus of claim 4, wherein each said deflectable structure includes a flexible tube wound in a spiral configuration with a sealed end directed toward a center of said spiral configuration.

6. The apparatus of claim 2 wherein said coupling means includes a capacitor charged in accordance with an output signal from said pressure transducer, and said alarm is operated according to a voltage established at said capacitor.

7. The apparatus of claim 6, additionally comprising:

a variable resistance providing an adjustable voltage level determining said threshold value; and a comparitor driving said alarm in accordance with a difference between said voltage established at said capacitor and said adjustable voltage level.

8. The apparatus of claim 6, wherein an output of said capacitor is connected through resistors between a voltage level and electrical ground.

9. The apparatus of claim 2, additionally comprising:

a variable resistance determining an adjustable voltage level determining said threshold value, and a comparitor driving said alarm in accordance with a difference between said voltage established at said capacitor and said second signal.

* * * * *